US006070671A

United States Patent [19]

Cumming et al.

[11] Patent Number: 6,070,671

[45] Date of Patent: Jun. 6, 2000

[54] CREATING ZONAL ISOLATION BETWEEN THE INTERIOR AND EXTERIOR OF A WELL SYSTEM

[75] Inventors: Francis Alexander Cumming; Simon Lawrence Fisher; Robert Bruce Stewart, all of Rijswijk, Netherlands

[73] Assignee: Shell Oil Company, Houston, Tex.

[21] Appl. No.: 09/128,500

[22] Filed: Aug. 3, 1998

[30] Foreign Application Priority Data

Aug. 1, 1997 [EP] European Pat. Off. ..... 97305832

[51] Int. Cl.[7] ..... E21B 43/10

[52] U.S. Cl. ..... 166/381; 166/50; 166/206; 166/207

[58] Field of Search ..... 166/381, 380, 166/277, 50, 206, 207

[56] References Cited

U.S. PATENT DOCUMENTS

| | | | |
|---|---|---|---|
| 3,477,506 | 11/1969 | Malone | 166/207 |
| 3,901,063 | 8/1975 | Nileshwar | 72/283 |
| 4,976,322 | 12/1990 | Abdrakhmanov et al. | 175/57 |
| 5,337,823 | 8/1994 | Nobileau | 166/277 |
| 5,366,012 | 11/1994 | Lohbeck | 166/277 |
| 5,462,120 | 10/1995 | Gondouin | 166/380 |
| 5,862,862 | 1/1999 | Terrell | 166/298 |
| 5,944,108 | 8/1999 | Baugh et al. | 166/313 |
| 5,964,288 | 10/1999 | Leighton et al. | 166/207 |
| 5,971,074 | 10/1999 | Longbottom et al. | 166/313 |

FOREIGN PATENT DOCUMENTS

| | | |
|---|---|---|
| WO 93/25799 | 12/1993 | WIPO . |
| WO 94/03698 | 2/1994 | WIPO . |

OTHER PUBLICATIONS

Paul Metcalfe, "Expandable Slotted tubes Offer Well Design Benefits," Slimhole Technology, *Hart's Petroleum Engineer International,* Oct. 1996.

*Primary Examiner*—Hoang Dang

[57] ABSTRACT

A method is provided for creating zonal isolation between the exterior and interior of an uncased section of an underground well system which is located adjacent to a well section in which a well casing is present. The method includes inserting an expandable tubular through the existing well casing into an uncased section, such as a lateral branch, of the underground well system and subsequently expanding the expandable tubular such that the one end is pressed towards the wall of the uncased section of the well system and the outer surface of the other end is pressed against the inner surface of the well casing thereby creating an interference fit capable of achieving a shear bond and a hydraulic seal between the surrounding surfaces.

7 Claims, 1 Drawing Sheet

CREATING ZONAL ISOLATION BETWEEN THE INTERIOR AND EXTERIOR OF A WELL SYSTEM

FIELD OF THE INVENTION

The invention relates to a method of creating zonal isolation between the interior and exterior of an uncased section of an underground well system which is located adjacent to a well section in which a well casing is present.

BACKGROUND OF THE INVENTION

It is known in the art to create zonal isolation by inserting a casing having a smaller diameter than the existing well casing into the uncased section of the borehole such that the small diameter casing extends through and beyond the existing well casing whereupon the small diameter casing is cemented into place.

If the uncased section of the underground well system is formed by a lateral borehole that extends from a well section in which a well casing is present then it is known to create zonal isolation by inserting a casing or liner through an opening that has been milled in the wall of the well casing and then cementing the casing or liner into place. A difficulty of this technique is that the milled opening generally has an irregular shape and that the cement that is pumped into the annulus around the casing or liner is not always equally distributed into the annular and provides an imperfect seal.

A general difficulty with the known zonal isolation cementing techniques is that they require an annulus having a significant width to create a cement body of uniform thickness and strength which results in a significant reduction of diameter of the completed well and consequent limitations of the well production capacity.

A method in accordance with the preamble of claim 1 is known from International patent application WO93/25799. In the known method a casing is expanded against the borehole wall, whereas in washouts cement is pumped into the surrounding annulus.

It is an object of the present invention to provide a zonal isolation method which can be carried out easier than the known method and which provides an adequate zonal isolation and does not require the presence of an annulus which is filled with cement.

SUMMARY OF THE INVENTION

The method according to the invention thereto comprises the steps of

- inserting an expandable tubular which is made of a formable steel grade through the existing well casing into the uncased section of the underground well system such that one end of the expandable tubular protrudes beyond the well casing into the uncased section of the well system and another end of the expandable tubular is located inside the well casing; and
- expanding the expandable tubular using an expansion mandrel having a conical ceramic surface such that the one end is pressed towards wall of the uncased section of the well system and the outer surface of the other end is pressed against the inner surface of the well casing thereby creating an interference fit capable of achieving a shear bond and a hydraulic seal between the surrounding surfaces.

Optionally a gasket material is inserted between the surrounding surfaces before expanding the tubular.

If the uncased section of the underground well system is formed by a lateral borehole that extends laterally from the well section in which the well casing is present through an opening in the tubular wall of the well casing and one end of the expandable tubular is inserted through the opening into the lateral borehole such that the other end of the expandable tubular still extends into the well section in which the well casing is present such that the other end is substantially co-axial to the well casing and the expandable tubular is subsequently expanded such that the one end is pressed towards the wall of the lateral borehole and the other end is pressed against the inner surface of the well casing. In that case, after expansion of the tubular an opening may be created in the wall of the expanded tubular to provide fluid communication between the parts of the well section in which the well casing is present above and below the lateral borehole.

The opening may be created by milling a window in the wall of the expanded tubular.

Alternatively the opening may be created by creating a pre-configured section having a smaller wall thickness than the other parts of the tubular which section breaks open as a result of the expansion process.

It is observed that International patent application WO94/03698 discloses a method for sealing the intersection between a primary and a branch borehole wherein use is made of a hollow whipstock.

BRIEF DESCRIPTION OF THE DRAWINGS

These and other features, objects and advantages of the method according to the invention will be more fully appreciated by reference to the following detailed description of preferred embodiments of the invention which should be read in conjunction with the accompanying drawings in which.

DETAILED DESCRIPTION OF THE PREFERRED EMBODIMENTS

Figure 1:
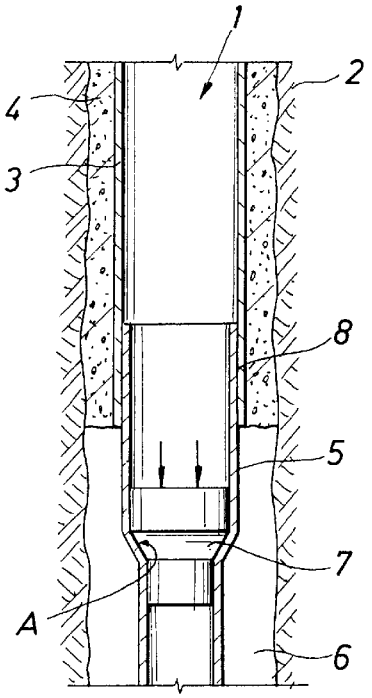
FIG. 1 is a schematic longitudinal sectional view of a well in which zonal isolation is created by expanding a tubular against an existing well casing.

Referring now to FIG. 1 there is shown a borehole 1 traversing an underground formation 2 and a well casing 3 that has been fixed within the borehole 1 by means of an annular body of cement 4.

An expandable tubular 5 in the form of a liner is run into the well casing 3 and maintained in a position that the lower end of the tubular protrudes into an uncased lower section of the borehole 1 and the upper end of the tubular is surrounded by the lower end of the well casing 3.

An expansion mandrel 7 is moved axially through the tubular 5 by pulling, pushing and/or pumping the pig 7 in the direction of the arrows. This causes the outer surface of tubular 5 to expand against the inner surface of the lower end of the well casing 3, thereby creating an interference fit 8 capable of achieving a shear bond and a hydraulic seal between the surrounding surfaces.

Experimental test data on unclad steel tubulars and steel tubulars clad with gasket material has confirmed that significant shear bond can be achieved. This is evidenced for example, by the shifting force of 650 kN/m required to remove a expanded tubular of dimensions (108×119 mm) (ID/OD) from a steel casing pipe of dimensions 119×133 mm (ID/OD).

The expansion mandrel 7 has a conical ceramic outer surface having a semi-top angle A between 5° and 45°, and preferably between 20° and 30°. The expandable tubular 5 is made of a formable steel grade which is subject to strain hardening without incurring any necking an ductile fracturing as a result of the expansion. Suitable formable steel grades are steel grades having a yield strength-tensile strength ratio which is lower than 0.8, preferably between 0.6 and 0.7, and a yield strength of at least 275 MPa. Steel grades which have these properties are dual phase (DP) high-strength low-alloy (HSLA) steel, such as Sollac grade DP55 or DP60 or Nippon grade SAFH 540 or 590 D, and formable high-strength steel grades, such as ASTM A106 HSLA seamless pipe, ASTM A312 austenitic stainless steel pipe, grades TP304 and TP316 and high-retained austenite high strength hot rolled steel, known as TRIP steel. These formable steel grades can be expanded by a ceramic cone 7 to an outer diameter which is at least 20% larger than the outer diameter of the unexpanded tubular.

In the example shown in FIG. 1 the expandable tubular 5 is a well liner which may be surrounded by a gravel pack (not shown) before the expansion pig 7 is run through the liner.

As a result of the expansion process the gravel pack will be compressed in the annular space which stabilizes the borehole 1 against caving in.

Figure 2:
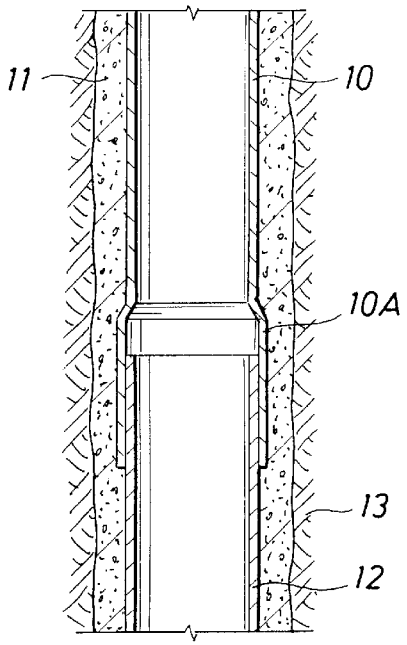
FIG. 2 is a schematic longitudinal sectional view of a well in which zonal isolation is created by expanding a tubular against an existing well casing of which the lower end has an enlarged inner diameter to create a mono-diameter well.

Referring now to FIG. 2 there is shown a borehole in which a well casing 10 has been installed and cemented in place by an annular body of cement 11. An expandable tubular 12 has been installed and expanded by a ceramic expansion cone in the same manner as described with reference to FIG. 1. However the lower end 10A of the well casing 10 has been expanded to a larger internal diameter than the rest of the casing. The tubular 12 is expanded against the lower end 10A of the well casing 10, thereby creating an interference fit between the mating surfaces of the tubular 12 and well casing 10. The lower end 10A of the well casing may be expanded together with the tubular 12 by the expansion cone while the annular body of cement 11 is still in a liquid state. As a result of the expansion a strong bond will be created between the cement and the tubular, the casing and the surrounding formation 13. The enlarged diameter of the lower part 10 of the casing 10 results in a well having a uniform internal diameter throughout the length of the well.

Figure 3:
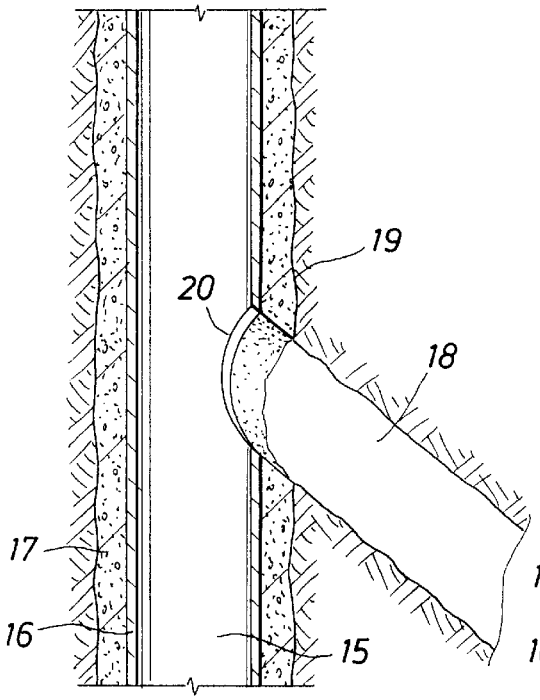
FIG. 3 is a schematic longitudinal sectional view of a lateral borehole which extends from a mother well which contains a well casing in which a window has been milled to create access to the lateral borehole.

Referring now to FIG. 3 there is shown a mother well 15 in which a well casing 16 is cemented in place by an annular body of cement 17. A lateral borehole 18 has been drilled laterally away from the mother well 15 into the underground formation 19.

At the junction point between the two wells an opening 20 has been milled in the casing 16 and surrounding body of cement 17 using, e.g. a conventional milling device which is induced by a whipstock below the junction point to mill the opening 20 the casing at the desired location. Such a milling operation generally generates an opening 20 having quite an irregular shape so that it is difficult to provide a zonal isolation between the well exterior and interior at the junction point and to anchor the casing (not shown) of the lateral borehole to the well casing of the mother well 15.

Figure 4:
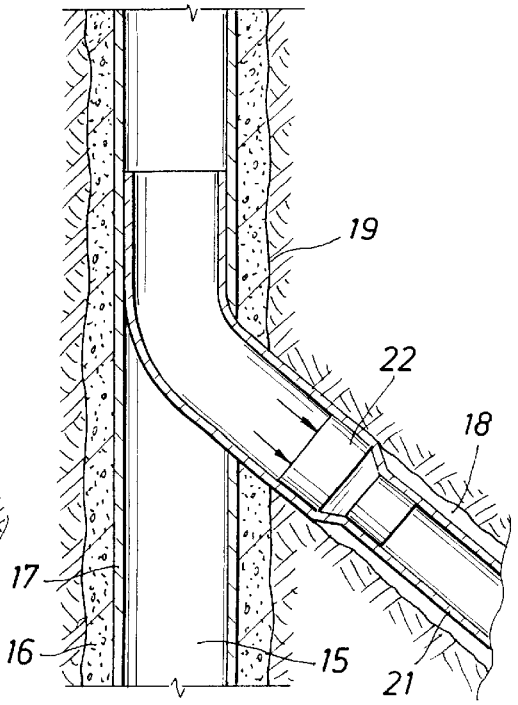
FIG. 4 is a schematic longitudinal sectional view of the well system of FIG. 3 after an expandable tubular has been inserted into the lateral well and expanded against the well casing of the mother well.

FIG. 4 shows how an expandable tubular 21 is inserted into the lateral borehole 18 from the mother well 15 such that the upper end of the tubular fits coaxially inside the well casing 16 of the mother well 15. The tubular 20 is expanded by moving an expansion mandrel 22 axially therethrough by pumping, pushing and/or pulling. The properties of the tubular 21 and mandrel 22 are the same as those described with reference to FIG. 1. As a result of the expansion process outer surface the upper end of the expanded tubular 21 is pressed against the inner surface of the casing 16 thereby creating an interference fit capable of creating a shear bond and a hydraulic seal between the mating surfaces.

The expanding tubular 21 is also pressed against the inner surface of the lateral borehole and the rims of the opening 20 in the well casing 16 and cement body 17 thereby creating a hydraulic bond between the expanded tubular 21 and the rims of the opening 20 and the inner surface of the lateral borehole 18.

In this manner the expanded tubular 21, and well casing 16 provide an adequate zonal isolation between the interior and exterior in the region of the junction between the lateral borehole 18 and the mother well 15 and robust anchoring of the tubular 21 to the well casing 16 is provided.

After having installed and expanded the tubular 21 a window (not shown) can be created in the wall of the tubular 21 to provide access to the part of the mother well 15 below the junction point.

Optionally a gasket material is provided on the outer surface of the tubular 21 before expansion of the tubular 21 to further enhance the zonal isolation provided by the expanded tubular 21.

If the rims of the milled opening 20 are irregular a liner having a regular oval opening may be installed against the inner surface of the casing 16 at the location of the junction, for example by expanding the liner using an expansion mandrel and arranging a slot or oval opening in the liner which will open up as a result of the expansion process to the desired oval shape.

Optionally at least the upper end of the tubular 21 may be expanded in a two stage expansion process where a flexible expansion mandrel is used in the second stage of the expansion process in order to firmly expand the tubular 21 against the casing 16, or optionally against the liner installed therein at the location of the junction, and against the rims of the opening 20 (or of the oval opening in the liner) and against the inner surface of the lateral borehole 18.

We claim:

1. A method of creating zonal isolation between the exterior and interior of an uncased section of an underground well system which is located adjacent to a well section in which a well casing is present, the method comprising the steps of:

inserting an expandable tubular through the existing well casing into the uncased section of the underground well system such that one end of the expandable tubular protrudes beyond the well casing into the uncased section of the well system and another end of the expandable tubular is located inside the well casing; and expanding the expandable tubular using an expansion mandrel having a conical surface, wherein the expandable tubular is made of a formable steel grade and is expanded by an expansion cone having a conical ceramic surface such that the one end is pressed towards wall of the uncased section of the well system and the outer surface of the other end is pressed against the inner surface of the well casing thereby creating an interference fit capable of achieving a shear bond and a hydraulic seal between the surrounding surfaces.

2. The method of claim 1, wherein a gasket material is inserted between the surrounding surfaces before expanding the tubular.

3. The method of claim 1, wherein the uncased section of the underground well system is formed by an extension of a wellbore which extends axially beyond the well section in which the well casing is present.

4. The method of claim 1, wherein the uncased section of the underground well system is formed by a lateral borehole that extends laterally from the well section in which the well casing is present through an opening in the tubular wall of the well casing and one end of the expandable tubular is inserted through the opening into the lateral borehole such that the other end of the expandable tubular still extends into the well section in which the well casing is present such that the other end is substantially co-axial to the well casing and the expandable tubular is subsequently expanded such that the one end is pressed towards the wall of the lateral borehole and the other end is pressed against the inner surface of the well casing.

5. The method of claim 4, wherein after expansion of the tubular an opening is created in the wall of the expanded tubular to provide fluid communication between the parts of the well section in which the well casing is present above and below the lateral borehole.

6. The method of claim 5, wherein the opening is created by milling a window in the wall of the expanded tubular.

7. The method of claim 1, wherein the tubular is made of a high-strength low-alloy (HSLA) steel having a yield strength-tensile strength ratio which is lower than 0.8 and a yield strength of at least 275 MPa.

* * * * *